US005370036A

United States Patent [19]

Stoner

[11] Patent Number: 5,370,036

[45] Date of Patent: Dec. 6, 1994

[54] TELESCOPED AMMUNITION REVOLVER GUN

[75] Inventor: Eugene M. Stoner, Palm City, Fla.

[73] Assignee: Ares, Inc., Port Clinton, Ohio

[21] Appl. No.: 595,428

[22] Filed: Oct. 11, 1990

[51] Int. Cl.[5] ..... F41A 9/36

[52] U.S. Cl. ..... 89/155

[58] Field of Search ..... 89/33.03, 155, 156, 89/157

[56] References Cited

U.S. PATENT DOCUMENTS 1,342,358 6/1920 Storle ..... 89/155

3,222,989 12/1965 Kamp ..... 89/155

*Primary Examiner*—Stephen C. Bentley

[57] ABSTRACT

Enclosed is a self-powered telescoped ammunition revolver gun, including a frame which mounts a revolver cylinder having circumferentially spaced chambers and a cylindrical exterior surface on which is formed at least two U-shaped open cam channels, each having forward facing open entrance and exit ends spaced apart by the same angular distance as the chambers. First and second elongated drive cylinders extend forward from the frame on separate axes disposed outboard of the revolver cylinder and circumferentially spaced apart by their same angular distance as the chambers. Each drive cylinder mounts a spring loaded operating rod having a gas piston at its forward end and an exposed cam driver/follower proximate its rear end for successively engaging the U-shaped open cam channels to rotate the revolver cylinder and drive the gun as the rod reciprocates linearly in its drive cylinder. Gas channeling and diverting means is coupled between the gun barrel and the forward ends of the drive cylinders for tapping gas from the barrel bore and alternately directing the gas to the first and second drive cylinders responsive to the firing of successive rounds and to the rotary position of the revolver cylinder.

6 Claims, 9 Drawing Sheets

8
3
24
26
30
38
34
40
12
18
22
130
14
160
142
152
144
16
140
164
156
10
20
216
224
225
214
120
68
110
118
171
158
154
146

FIG. 5.
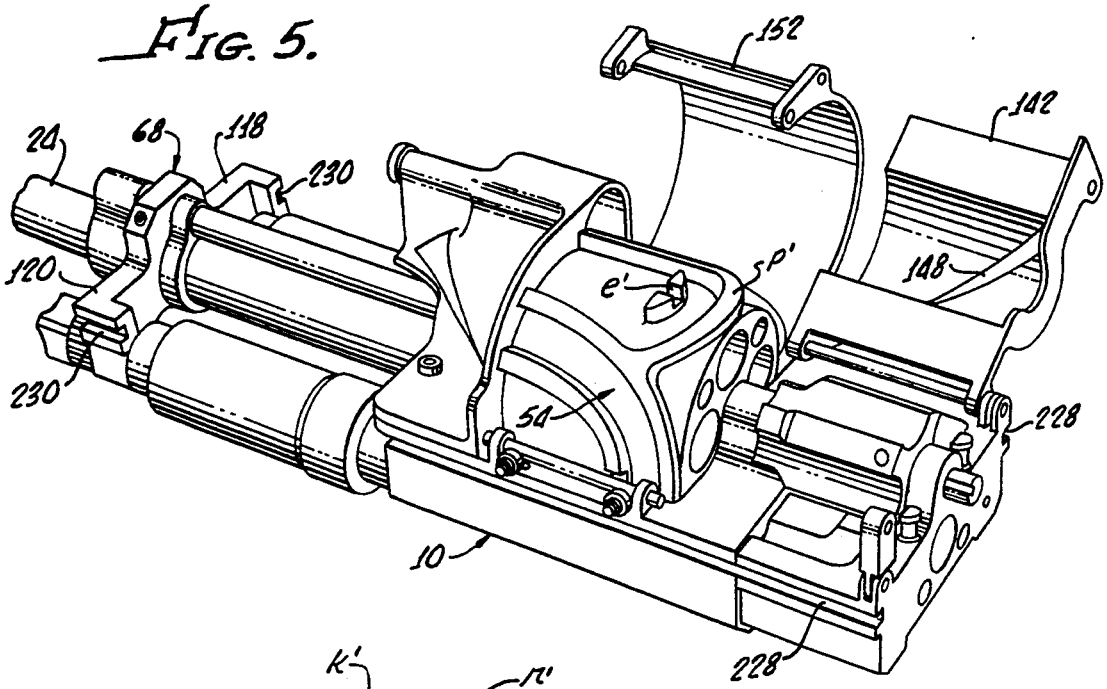
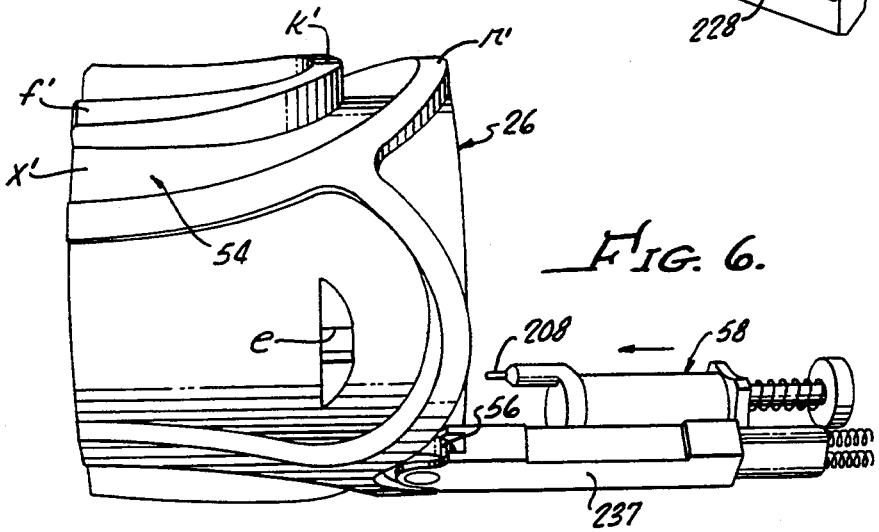
FIG. 6.
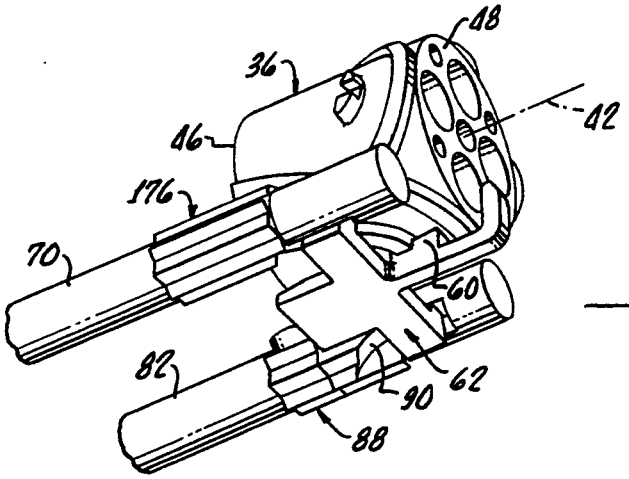
FIG. 7.

FIG. 12.
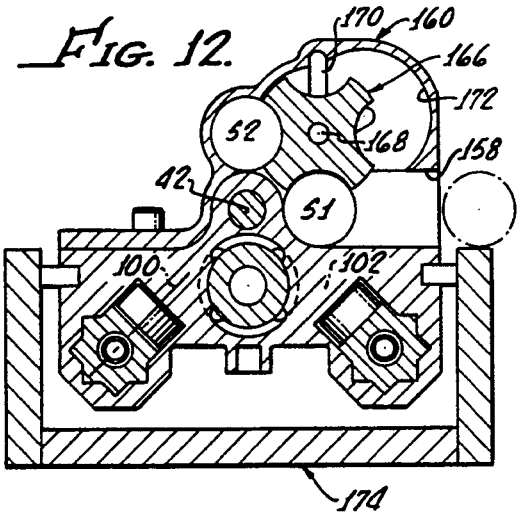
FIG. 13.
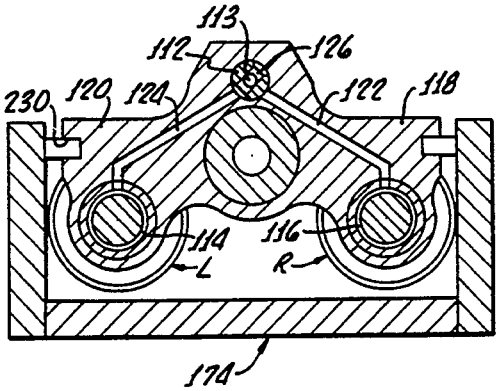
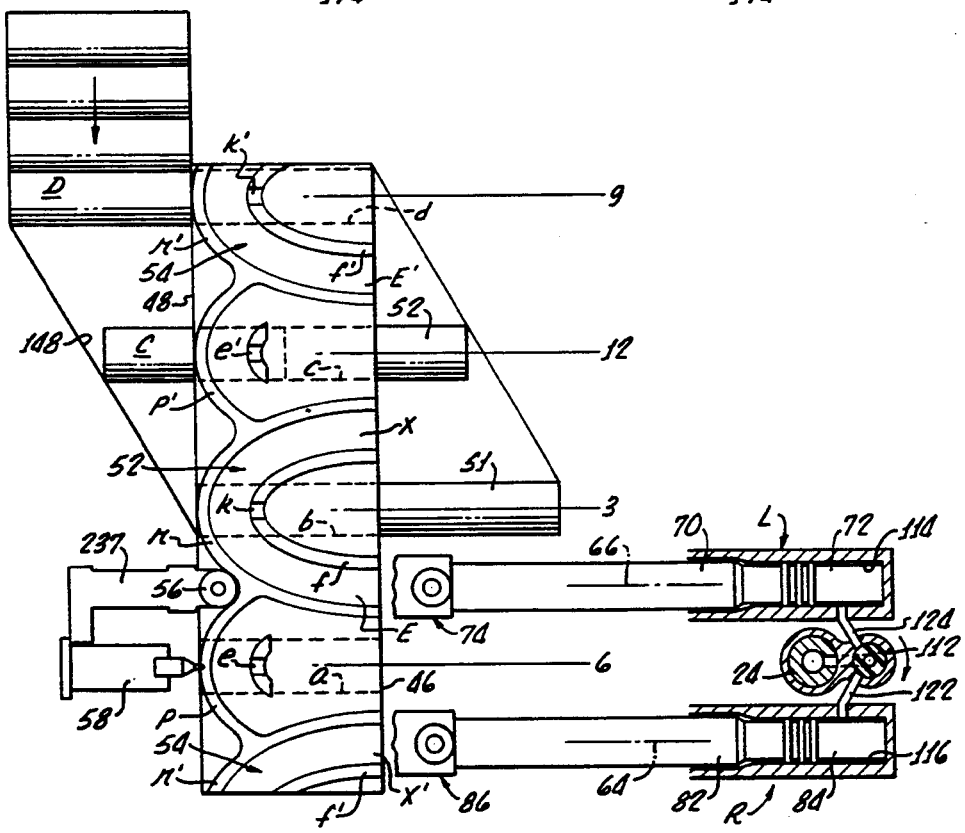
FIG. 14.

TELESCOPED AMMUNITION REVOLVER GUN

This invention relates to revolver guns and has particular reference to a self-powered automatic revolver gun for firing cylindrically cased telescoped ammunition rounds at a high rate of fire, and improvements therein.

BACKGROUND OF THE INVENTION

Conventional military revolver guns such as the M 39 20 mm self-powered revolver gun rely on a gas actuated piston to move an elongated cam which engages a series of cam followers attached to the revolver cylinder. Some revolver gun designs use a full parabolic cam with spring loaded cam followers and others use "half-cams" and a switch mechanism to select different cam followers during recoil and counter-recoil.

Also, the typical revolver gun fires conventionally shaped ammunition, with the typical revolver cylinder chamber including the profile of the ammunition case and a short forward section of reduced straight bore diameter to accommodate the projectile of the round. When the normal revolver gun is fired, the projectile travels the short distance of straight bore at the forward end of the revolver chamber before it "jumps the gap" and enters the actual barrel. The hot, burning propellant gasses follow the base of the projectile and "wash" on the straight bore section of the revolver chamber. At sustained firing rates, the revolver cylinder gets very hot because of this gas wash with serious potential for causing premature detonation of rounds, referred to as "cook-off". To maintain barrel gas pressure and projectile velocity, as well as to avoid undesirable emission of large amounts of barrel gasses at the revolver cylinder, in the typical revolver gun the gap between the revolver cylinder and the rear end face of the barrel must be sealed by a separate delicate component that causes extra machining expense, extra maintenance and can be troublesome operationally.

The geometry of normal revolver guns is such that a fired conventional ammunition case must be extracted out the rear of the revolver chamber and be clear of the area before significant rotation of the revolver cylinder is possible. For high firing rates the conventional revolver gun relies upon high velocity ejection and high velocity ramming of new rounds into the revolver chambers by complex mechanisms responsive to the gas actuated piston and associated operating rod and cams. Further, the typical revolver gun requires high velocity charging to initially load the revolver cylinder in preparation for firing, a further complication.

In the past few years there has been increasing interest in the advantages offered by cylindrically cased telescoped ammunition rounds, and various gun mechanisms have been proposed for firing such rounds: See, for example, the gun mechanism shown in U.S. Pat. No. 4,791,851. However, so far as is known, revolver guns have not been adapted to the use of cylindrically cased telescoped ammunition rounds, except by the present invention. Although they provide significant advantages, such telescoped ammunition rounds require gentler handling by the gun mechanism than do conventional rounds.

In accordance with the present invention, a self-powered revolver gun is provided which is lighter weight, significantly less complex, more reliable, and capable of higher sustained firing rates than a conventional revolver gun while also having the advantage of firing telescoped ammunition rounds.

Also, the gun design, according to the present invention, provides a revolver gun having considerable advantages in various applications as compared to present conventional machine guns which fire conventional ammunition of the same caliber.

For example, by comparison with a Browning M2 HB (0.50 CAL) Machine Gun, a corresponding revolver gun of the present design firing the same caliber projectiles in cylindrically cased telescoped ammunition, is much more compact, much lighter weight, has a significantly higher rate of fire, an equal or higher muzzle velocity and about one-third fewer parts. Moreover, there is a large reduction in ammunition weight for the same number of ammunition rounds. These factors can be very significant for guns mounted on helicopters, for example.

For general reference, a cylindrical, plastic cased telescoped ammunition round is disclosed in U.S. Pat. No. 4,770,098.

SUMMARY OF THE INVENTION

In accordance with the present invention, the revolver gun includes a gun frame, with a gun barrel mounted to and extending forward therefrom. The gun frame has a breech region disposed rearwardly and adjacent the rear end of the gun barrel for mounting a revolver cylinder, an ammunition receiver region disposed rearward of and adjacent the breech region, and a spent ammunition case receiving and ejection region disposed forward of and adjacent the breech region.

The revolver cylinder has a cylindrical exterior surface rear and forward end faces, and has an even plurality of at least four cylindrical ammunition chambers for chambering cylindrically cased telescoped ammunition rounds. These chambers extend longitudinally through the revolver cylinder and its end faces on axes parallel to and disposed at uniformly spaced loci arranged in a circular array centered on the central longitudinal axis of the revolver cylinder, with the loci being evenly spaced a predetermined angular distance apart to together encompass 360°.

The revolver cylinder is mounted in the breech region of the gun frame for rotation about its central longitudinal axis with the front end face of the revolver cylinder disposed adjacent to the rear end of the gun barrel and with the central longitudinal axis of the revolver cylinder disposed parallel to but offset from the gun barrel axis by the radius of the circular array of revolver loci, so that rotation of the revolver cylinder brings the axes of the cylindrical chambers of the revolver cylinder successively into coaxial registration with the axis of the gun barrel.

The gun includes a triggering means and a responsive firing means for firing a cylindrically cased telescoped ammunition round contained in the cylindrical chamber of the revolver cylinder in coaxial registration with the gun barrel.

At least two substantially U-shaped open cam channels are similarly formed on the exterior cylindrical surface of the revolver cylinder respectively at circumferentially spaced apart locations, with the bend of each U-shaped cam channel disposed proximate the rear end face of the revolver cylinder, and with the respective legs of each U-shaped cam channel extending forward on the exterior cylindrical surface and through the periphery of the front end face of the revolver cylinder for providing respectively open entrance and exit ends for each U-shaped cam channel at the periphery of the forward end face of the revolver cylinder.

The open entrance and exit ends for each U-shaped cam channel are circumferentially spaced apart at the forward end face of the revolver cylinder by the same predetermined angular, distance by which the axes of the revolver cylinder chambers are spaced, with the exit end of each U-shaped cam channel being spaced apart from the entrance end to the circumferentially successive U-shaped cam channel by the same predetermined angular distance, and with the sum of the angular distances as thus stated between the entrance and exit ends for each U-shaped cam channel and between successive U-shaped cam channels adding to 360°.

Gun drive means are mounted to the gun frame and extend forwardly therefrom alongside the gun barrel. The gun drive means is responsive to the firing of successive ammunition rounds for successively driving the revolver cylinder through the predetermined angular distance in the same rotary direction, upon the firing of each successive ammunition round.

The gun drive means includes first and second elongated drive cylinders mounted to the gun frame and extending forwardly therefrom alongside the barrel on separate axes disposed parallel to the barrel axis but outboard of the exterior cylindrical surface of the revolver cylinder, with the separate axes of the drive cylinders being circumferentially spaced apart about the revolver cylinder by said predetermined angular distance.

Also included are first and second elongated operating rods which are respectively mounted in the first and second drive cylinders and extend rearwardly therefrom into recesses in the gun frame. The operating rods are restricted to linear, non-rotary reciprocal rearward and forward movement between a rear position and a forward or rest position.

Each operating rod has a gas piston formed proximate the forward end thereof, and has a cam driver/follower mounted thereon proximate the rearward end thereof, with the cam driver/follower being exposed externally of the drive cylinder and extending inwardly from the operating rod toward the circumference of the revolver cylinder to align with the exterior cylindrical surface thereof for driving the revolver cylinder by entering the aligned entrance end of successive U-shaped cam channels and exiting the exit end thereof as the operating rod reciprocates and the revolver cylinder rotates.

The operating rods are spring loaded toward their forward rest positions where each cam driver/follower is disposed a spaced distance forward of the front end face of the revolver cylinder.

The gun drive means also includes gas channeling and diverting means coupled between the barrel and forward end portions of the first and second drive cylinders, and responsive to the firing of successive ammunition rounds and to the rotary position of the revolver cylinder for tapping gas from the barrel bore and alternately directing such barrel gas to the first and to the second drive cylinders, thereby to alternately drive the first and second operating rods rearwardly so as to drive the associated driver/follower into an aligned entrance end of an aligned U-shaped cam channel and in turn rotate the revolver cylinder through said predetermined angular distance as the driver/follower traverses the U-shaped cam channel and emerges from the exit end thereof.

The gun includes an indexing means, responsive to the position of the operating rods and rotary position of the revolver cylinder, for unlocking and locking the revolver cylinder from rotation between firing of successive cylindrically cased telescoped ammunition rounds.

Ammunition receiver and rammer means are mounted on the gun frame in the ammunition receiver region thereof, for receiving fresh ammunition rounds and progressively ramming a fresh ammunition round into each revolver chamber following firing of the round contained therein, while progressively pushing forward and out of the ammunition chamber the spent cylindrical case of the fired round, as the revolver cylinder is rotated about its axis.

Spent case receiving and ejection means are mounted to the gun frame in the spent ammunition case receiving and ejection region thereof, for receiving spent ammunition cases as they progressively emerge from the successive revolver chambers and for ejecting fully emerged cases from the gun as the revolver cylinder rotates.

In the preferred embodiment of the invention, the revolver cylinder has four cylindrical ammunition chambers, the predetermined angular distance is 90° and there are similar U-shaped open cam channels formed on the cylindrical surface of the revolver cylinder.

The foregoing and other important features of the present invention will be better understood by reference to the following detailed description of a preferred embodiment of the invention as illustrated in the accompanying drawings.

BRIEF DESCRIPTION OF THE DRAWINGS

Referring now to the accompanying drawings:

FIG. 5 is a perspective view of the revolver gun with the covers open to better show the revolver cylinder and feed sprocket, viewed from the left, top rear;

FIG. 6 is a perspective view of the revolver cylinder, illustrating the cooperation therewith of the firing pin carrier and the cam follower for resetting the firing pin carrier.

FIG. 7 is a perspective view looking upwardly of the revolver cylinder, rear portions of the operating rods and the revolver cylinder sear;

FIG. 12 is a cross-section taken along line 12—12 of FIG. 3;

FIG. 13 is a cross-section taken along line 13—13 of FIG. 3;

FIG. 14 is a schematic development of the outer cylindrical surface of the revolver cylinder and the U-shaped open cam channels and other structures formed thereon, shown in cooperative relationship with other elements of the gun including firing pin carrier and reset cam, revolver chambers, ammunition feed, ramming and ejection paths, drive cylinders and operating rods with cam drivers/followers in their forward rest position;

DETAILED DESCRIPTION OF THE PREFERRED EMBODIMENT

Figures 1, 2:
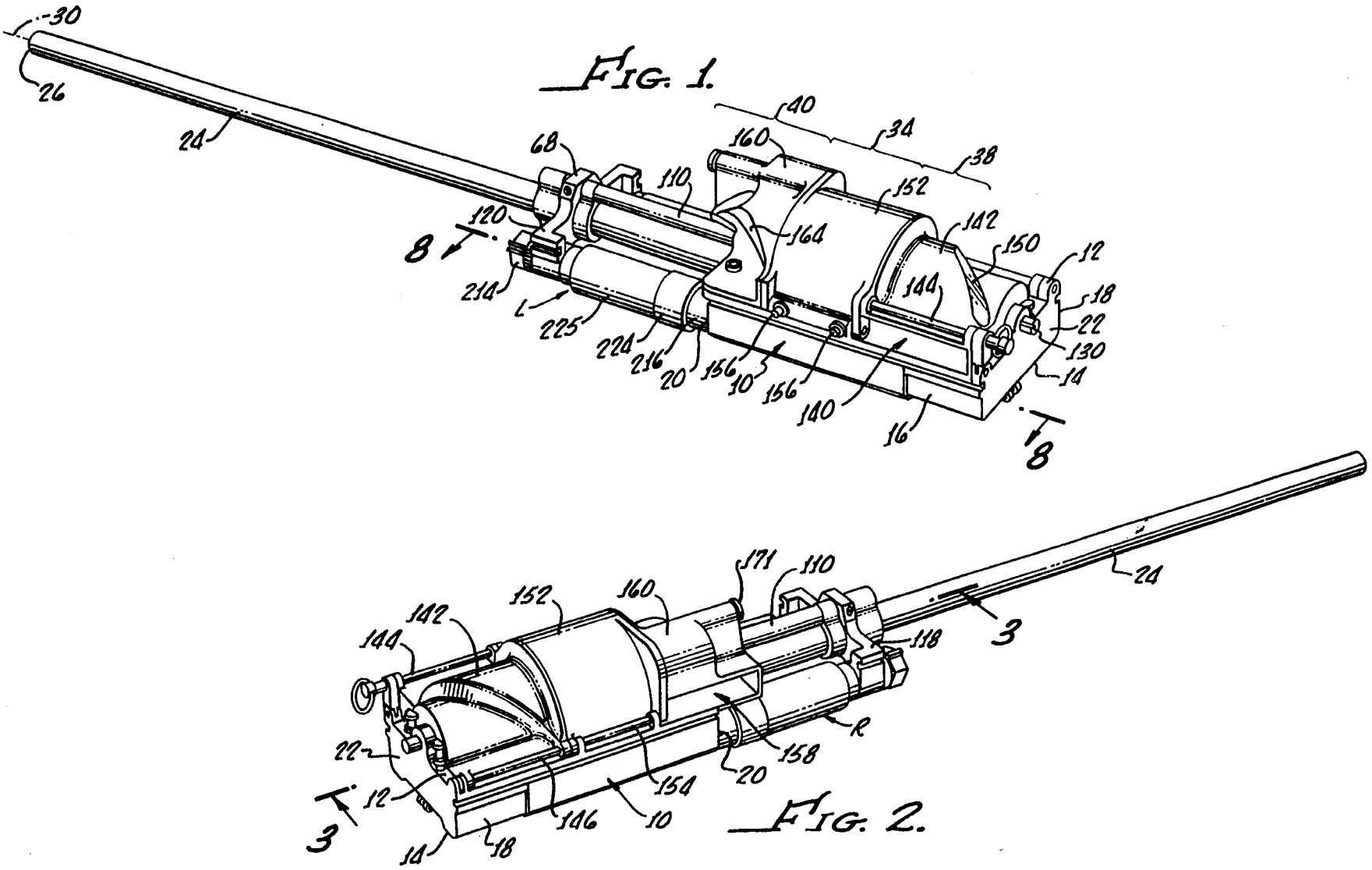
FIG. 1 is a pictorial view of the preferred embodiment of the revolver gun of the present invention as seen from the top, left rear.
FIG. 2 is a pictorial view of the preferred embodiment of the revolver gun of the invention as seen from the top, right rear.
Figure 3:
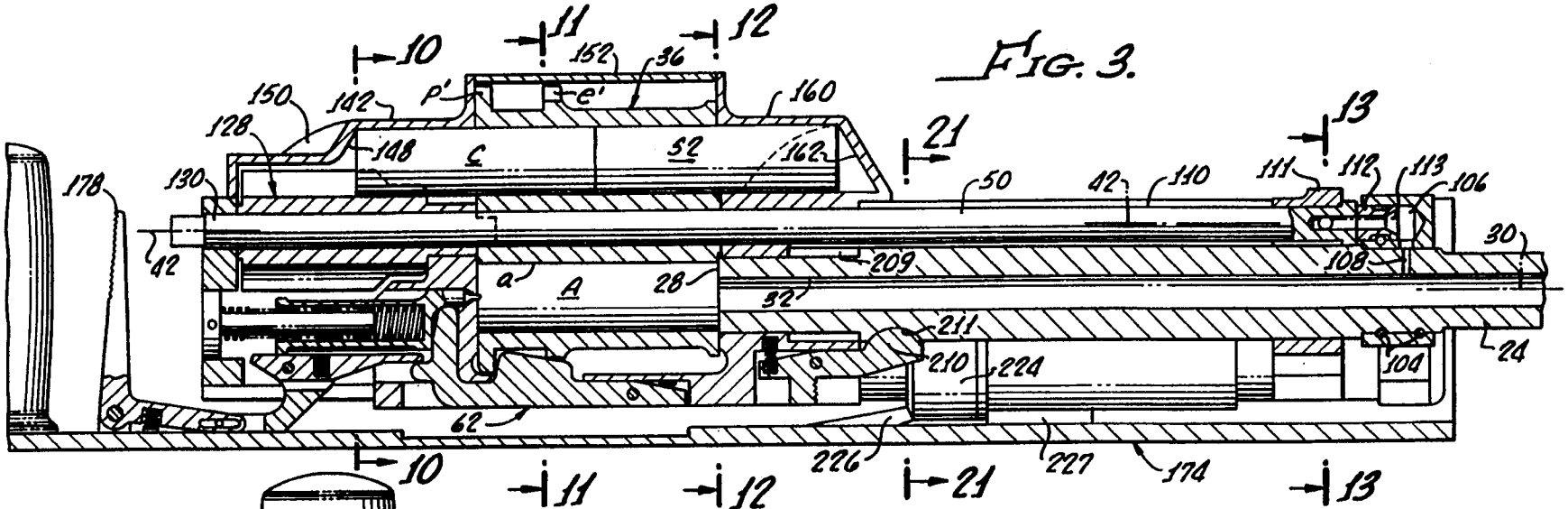
FIG. 3 is a sectional elevation taken generally along line 3—3 of FIG. 2 and illustrating the revolver gun residing in a cradle with a manual trigger.

Referring now to the drawings, principally FIGS. 1 thru 3, the revolver gun of the present invention includes a gun frame 10 having a top, bottom and opposite lateral sides 12, 14, 16, 18, respectively and forward and rear ends 20,22. A single gun barrel 24 is mounted to and extends forward from the gun frame 10. The gun barrel has forward and rearward ends 26: 28, a longitudinal axis 30, and a bore 32 centered on and extending along the longitudinal axis 30 of the gun barrel.

The gun frame has a breech region 34 extending rearwardly from adjacent the rear end of the gun barrel for mounting a revolver cylinder 36, an ammunition receiver region 38 extending rearwardly from adjacent the breech region 34, and a spent ammunition case receiving and ejection region 40 extending forward from and adjacent the breech region 34. The length of each region is about equal to that of one cylindrical ammunition round.

The receiver cylinder 36 has a central longitudinal axis 42, a cylindrical exterior surface 44 disposed coaxially with the longitudinal axis 42, and rear and forward end faces 46, 48.

Figure 11:
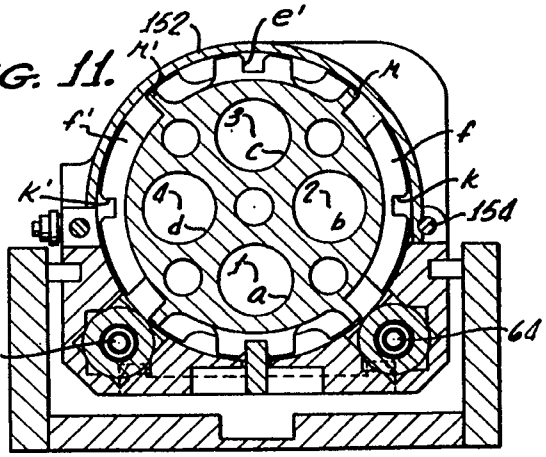
FIG. 11 is a cross-section taken along line 11—11 of FIG. 3.

Four cylindrical chambers, a, b, c, d, extend longitudinally thru the revolver cylinder 36 and its end faces respectively on axes 1, 2, 3, and 4, disposed parallel to and at uniformily spaced loci arranged in a circular array centered on the central longitudinal axis 42 of the receiver cylinder, with the loci of said axes being evenly spaced 90° apart so as to together encompass 360° (FIG. 11).

The revolver cylinder 36 is rotatably mounted in the breech region of the gun frame for rotation about its central longitudinal axis 42 by means of an elongated gas control rod 50 which is journaled in the gun frame and disposed coaxially with the revolver cylinder and connected thereto for rotation therewith. The front end face of the revolver cylinder is disposed adjacent the rear end of the gun barrel and the central longitudinal axis 42 of the revolver cylinder is disposed parallel to but offset above the gun barrel axis 30 by the radius of the circular array of the revolver chamber axes loci, so that rotation of the revolver cylinder about its axis 42 brings the axes 1, 2, 3, 4 of the cylindrical chambers of the revolver cylinder successively into coaxial registration with the axis 30 of the gun barrel. As depicted in FIGS. 3 and 11, when looking forwardly from the rear, cylindrical chamber "a" has its axis 1 disposed coincident with the gun barrel axis 30 in the six o'clock position, with cylindrical chamber c being disposed 180° therefrom about the revolver cylinder axis 42 and in the 12 o'clock position. When viewed from the rear looking forward, the revolver cylinder is driven intermittently to rotate clockwise in 90° increments.

Figure 15:
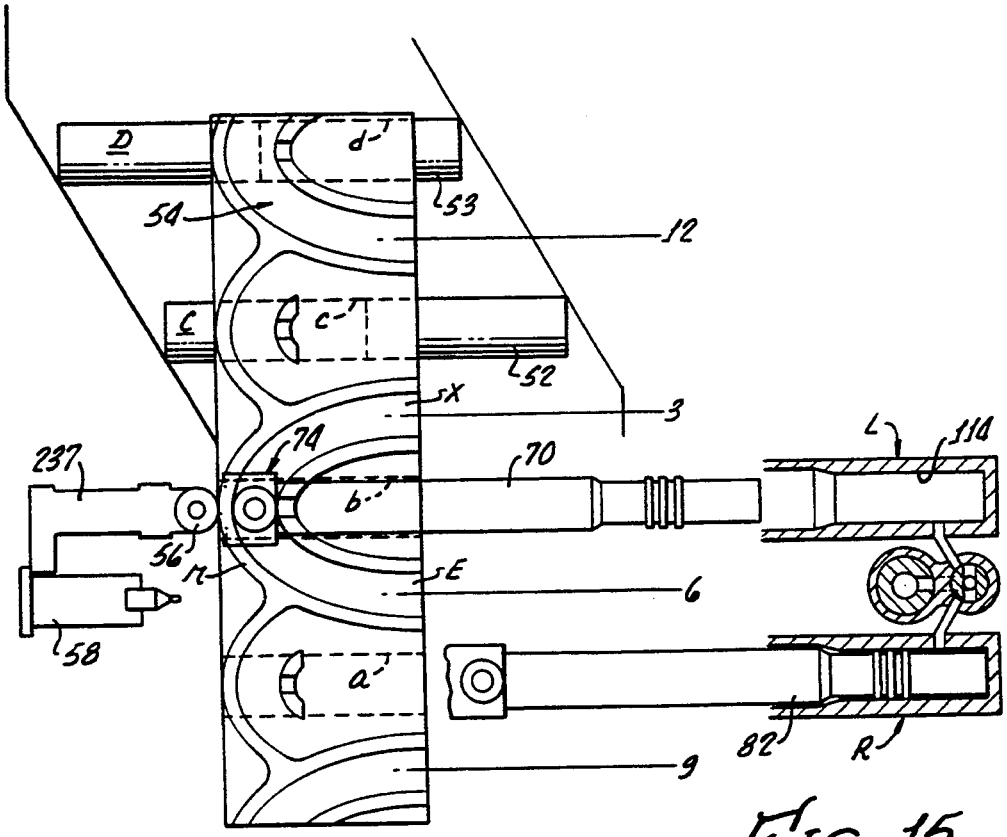
FIG. 15 is a schematic development similar to FIG 14 showing the relative positions immediately after firing when the revolver cylinder has turned through 45°.
Figure 16:
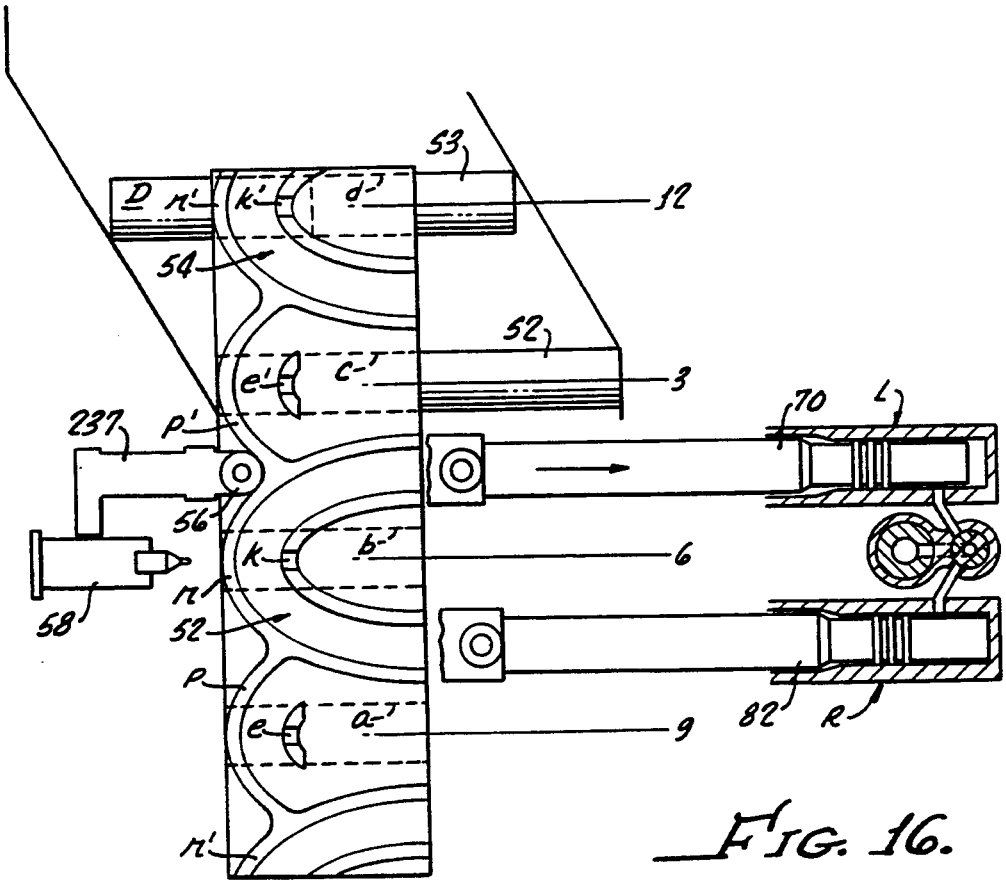
FIG. 16 is a schematic development similar to FIG. 15, showing relative positions upon rotational movement of the revolver cylinder through 90°.

As illustrated, for example in FIGS. 14 thru 16 which depict the outer cylindrical surface 44 of the revolver cylinder in schematic planar development, first and second substantially U-shaped open cam channels 52, 54 are similarily formed on the exterior cylindrical surface 44 of the revolver cylinder at circumferentially spaced apart locations with the center of the bend of each U-shaped open cam channel disposed proximate the rear end face 48 of the revolver cylinder and with the respective legs of each U-shaped open cam channel extending forwardly on the exterior cylindrical surface 44 and through the periphery of the front end face 46 of the revolver cylinder for providing respectively an open entrance and exit end for each U-shaped open cam channel at the periphery of the forward end face 46 of the revolver cylinder.

Thus, the first U-shaped open cam channel 52 is formed on the exterior cylindrical surface 44 by a protruding rear cam race r of elliptical curvature in planar development and a corresponding forward cam race f parallel thereto so as to define the first cam channel 52 and an open entrance end E and an open exit end X for this cam channel 52 at the periphery of the forward end face 46 of the revolver cylinder. Similarily, the second U-shaped open cam channel 54 is formed by a similar rear race r' and forward race f' to define the cam channel 54 and an open entrance end E' and an open exit end X' for the second cam channel 54. The angular circumferential spacing around the cylindrical surface 44 and its axis 42 measured center to center between the open entrance and exit end E, X for the first cam channel 52 and between the open entrance and exit end E', X' for the second cam channel 54, as well as between the exit end X of the first cam channel 52 and the entrance end E' of the second cam channel 54 and between the exit end X' of the second cam channel 54 and the entrance end E of the first cam channel 52 is 90°, such that these four 90° angular distances add to 360°, noting that the 90° spacing is the same angular distance by which the axes 1, 2, 3, 4 of the revolver cylinder chambers a, b, c, d are spaced about the revolver cylinder axis 42.

Proximate the rear of the two spaces on the exterior cylindrical surface 44 disposed between the first and second U-shaped open cam channels 52, 54 and respectively centered therein are first and second bridging protrusions p and p' similar to the central 90° circumferential portion of the rear cam races r, r', thus providing in composite an undulating rear cam surface, elevated on the exterior cylindrical surface 44 of the revolver cylinder by the races and bridging protrusions p, r, p', and r' for engagement by a reset cam roller 56 to automatically reset or cock a firing pin carrier 58 each time the revolver cylinder is rotated through 90°.

The forward cam races f, f' of the U-shaped cam channel 52, 54 at the apex of tile U-bend thereof respectively have formed therein a key-way k and k'. Protrusions simulating the apex of the forward cam races f, f' and having key-ways e, e' formed therein are respectively centered in the two circumferential spaces separating the first and second cam channels 52, 54. The result is four key-ways e, k, e', k' spaced 90° apart in circumferential alignment about the exterior cylindrical surface 44 of the revolver cylinder. These key-ways cooperate with a key 60 formed on a revolver cylinder sear 62 for unlocking and locking the revolver cylinder 36 from rotation about its axis between firing of successive ammunition rounds.

Right and left elongated drive cylinders R, L, are mounted to the gun frame and extend forwardly therefrom parallel to barrel 24 on separate axes 64, 66 to connect with a yoke for 68 mounted to the barrel 24.

As illustrated, for example in FIG. 11, the respective drive cylinder axes 64, 66 are disposed outboard of the revolver cylinder 36 and are located (looking from the rear forwardly) at the 4:30 and 7:30 clock positions respectively, it being noted that the revolver cylinder "a" and its axis 1 is disposed in the six O'clock position in registration with the gun barrel axis 30. Thus, the drive cylinder axes 64, 66 are disposed at locations circumferentially spaced apart by an angular distance of 90° about the revolver cylinder axis 42 respectively at 45° on opposite sides of the six O'clock barrel axis position.

Figure 8:
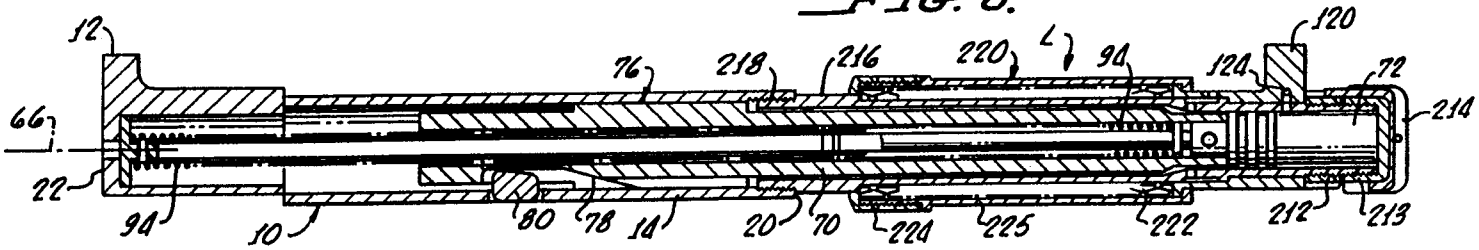
FIG. 8 is a sectional view of a drive cylinder and rearwardly aligned portion of the gun frame, with the operating rod shown in its forward position, generally taken along line 8—8 of FIG. 1.
Figure 9:
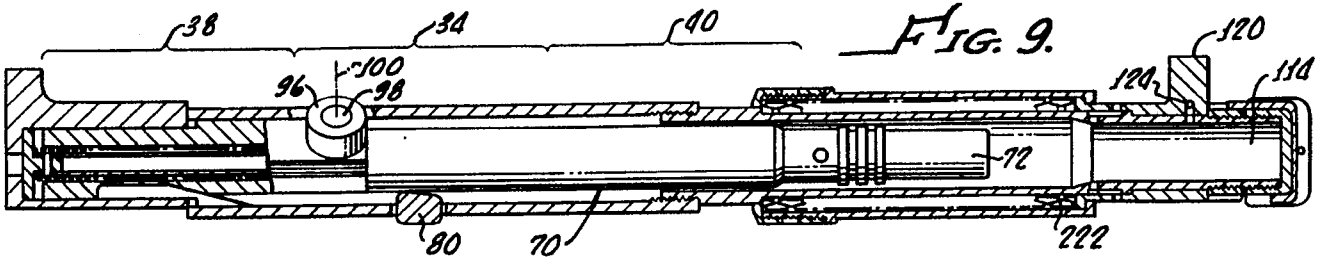
FIG. 9 is a sectional view partially in elevation of the same drive cylinder illustrating the operating rod and the cam driver/follower connected therewith in its rear position.

The left drive cylinder L is typical and is best illustrated in FIGS. 8 and 9. It includes an operating rod 70 having a gas piston 72 formed proximate the forward end thereof and having a cam driver/follower 74 mounted thereon proximate the rearward end thereof as well as a longitudinally splined region 76 (FIGS. 7 and 8) which cooperates with a correspondingly shaped passage in the gun frame, for example, as seen at 77 in FIG. 17 to restrict movement of the operating rod to non-rotary reciprocal rearward and forward movement along its axis 66. The operating rod 70 also has a cam recess and ramp 78 formed proximate the rear end thereof which cooperates with a left arm cam 80 of the revolves cylinder sear 62.

The right drive cylinder R is of similar construction and includes an operating rod 82 having a gas piston 84 formed proximate the forward end thereof with a cam driver/follower 86 mounted thereon proximate the rear end thereof as well as a splined region 88 restricting movement of the operating rod to non-rotary reciprocal movement along its axis 64, ant with a corresponding cam recess and ramp 90 which cooperates with a right arm cam 92 of the revolver cylinder sear 62.

Both operating rods 70, 82, are spring loaded in the forward direction along their axes, the construction being typified as shown in FIG. 8 for the operating rod 70 which is spring loaded by a conventionally mounted central compression or operating spring 94.

The construction of the cam driver/follower 74 for the left operating rod 70, includes a roller 96 mounted on a stub shaft 98 and rotatable on the stub shaft about its axis 100. The axis for the roller of the right cam driver/follower 86 is indicated at 102, it being noted that the axes for both rollers are radial with respect to the revolver cylinder axis 42 and disposed at 45° on opposite sides of the six O'Clock position, so that the rollers are presented in proper alignment with the open entrance ends of the U-shaped cam channels 52, 54 at the periphery of the cylindrical surface 44 at the forward end face 46 of the revolver cylinder.

As seen in FIG. 3, the yoke 68 is locked to the barrel 24 by a pair of pins 104 and has an upper gas chamber 106 aligned with the common axis 42 of the revolver cylinder and gas control rod 50. An orifice 108 extends thru the barrel 24 for communicating barrel gases from the bore 32 to the chamber 106. The gas control rod 50, which is rotatable in an elongated housing 110, is held to the barrel by a mounting collar 111, and is coupled at its forward end to a rotary valve 112 which rotatably seats in the rear of chamber 106 and has a longitudinal orifice 113 extending therethrough in communication with the front of the chamber 106.

As best seen in FIGS. 9 and 13 thru 16, the left drive cylinder L has a gas chamber 114 which cooperates with the gas piston 72 of the left operating rod 70, and the right drive cylinder R has a corresponding gas chamber 116 which cooperates with the gas piston 84 of its operating rod 82. The yoke 68 has a right arm 118 which mounts the forward end of the right drive cylinder R and a left arm 120 which mounts the forward end of the left drive cylinder L. An orifice 122 extends thru the yoke and its right arm 118 to communicate between the gas chamber 116 of the right drive cylinder R and the yoke chamber 106 at the position where the valve 112 seats therein, with the orifice 122 opening into the yoke chamber 106 at the 4:30 O'Clock position.

Correspondingly, an orifice 124 extends thru the yoke its left arm 120 to communicate between the gas chamber 114 of the left drive cylinder L and the yoke chamber 106 at the position where the rotary valve 112 seats therein, the orifice 124 opening into the yoke chamber 106 at the 7:30 O'Clock position.

The valve 112 has a transverse orifice 126 extending thru it and intercepting its longitudinal orifice 113. By inspection, it will be seen that with each succeeding 90° rotation of the gas control rod 50 about its axis 42 resulting in a 90° rotation of the rotary valve 112 seated in the yoke chamber 106, alternatively the right and left orifices 122, 124 will be exclusively in communication with the barrel bore 32 thru the orifices 108, 113 of the rotary valve 112, thus alternatively supplying barrel gases to the gas chambers 114 of the left and right drive cylinders L, R.

As seen in FIG. 9, when barrel gasses are supplied to the gas chamber 114 of a drive cylinder, the corresponding operating rod 70 is driven rearwardly and compresses the operating spring 94. This, of course, moves the associated cam driver/follower 74 rearwardly and into an aligned entrance end of one of the U-shaped open cam channels 52, 54 and turns the revolver cylinder about its axis 42.

As seen in FIG. 14, in the forward or rest positions of the operating rods 70, 82, the associated cam driver/followers 74, 86, are forward and clear of the revolver cylinder and, but for engagement of the key 60 of the revolver cylinder sear 62 with one of the key-ways, once the firing pin carrier 58 is cocked, the revolver cylinder is free to rotate about its axis 42. This facilitates initial charging of the revolver cylinder with ammunition rounds.

Figure 10:
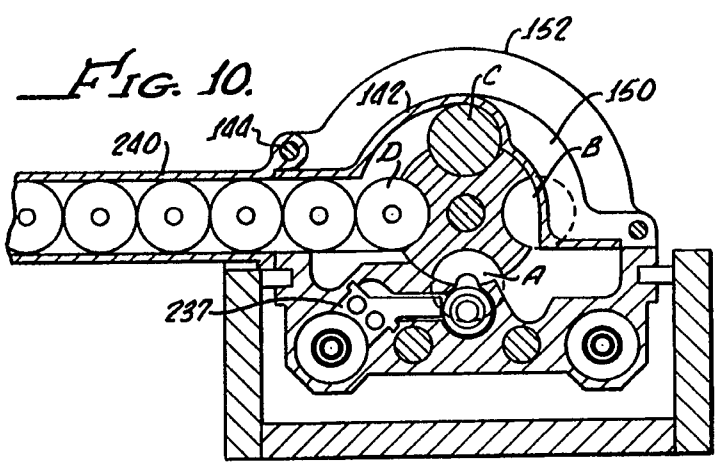
FIG. 10 is a cross-section taken along line 10—10 of FIG. 3.
Figure 17:
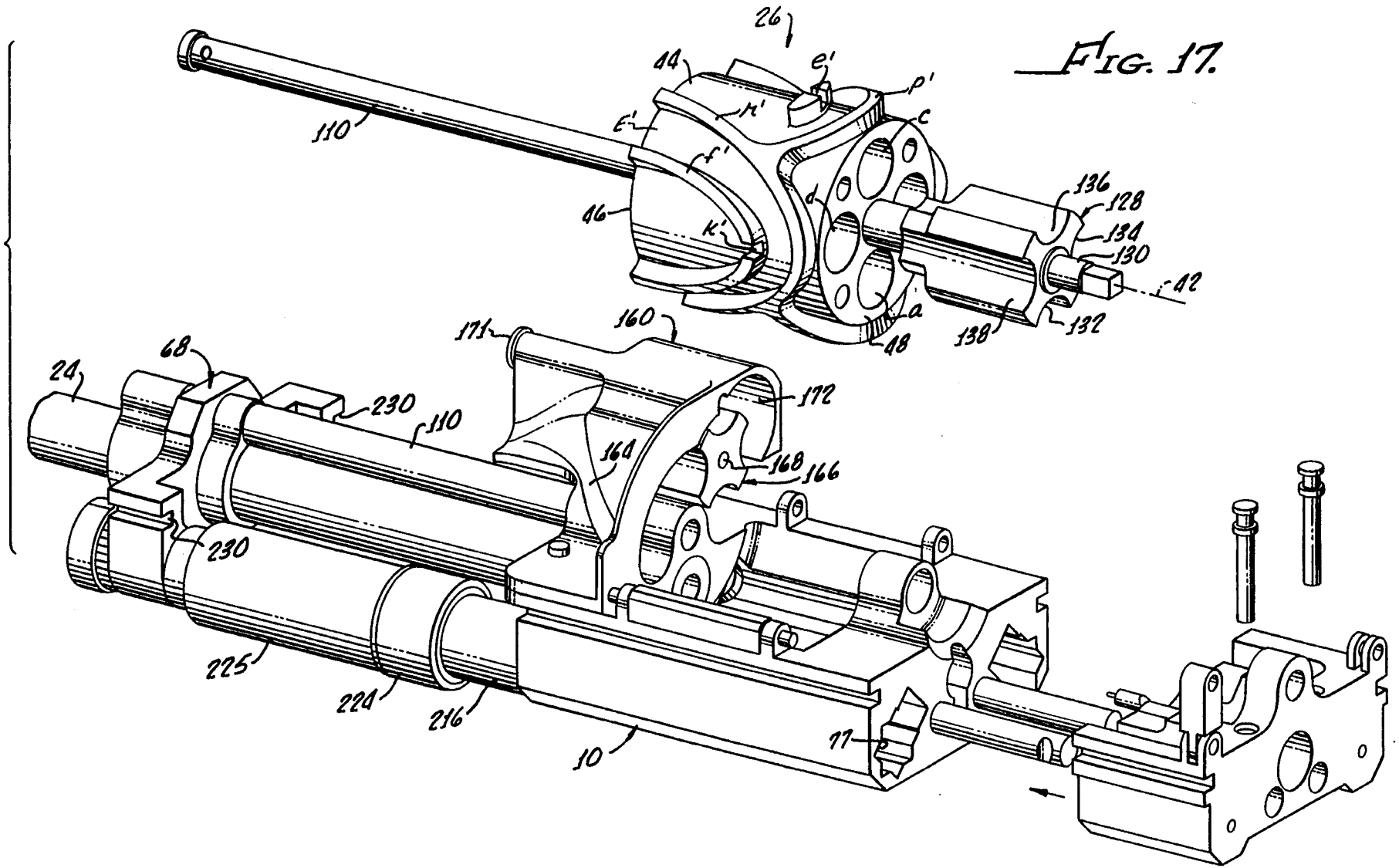
FIG. 17 is an exploded perspective, illustrating the gun mechanism with the control rod, revolver cylinder and feed sprocket removed and shown in overlying relationship.
Figure 18:
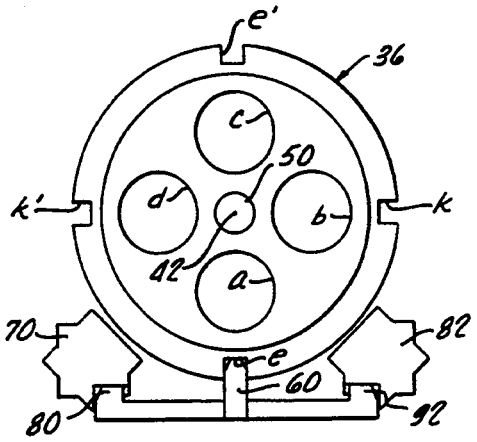
FIG. 18 is a view similar to FIG. 11, simplified to illustrate the cooperation between the operating rods and revolver cylinder sear.
Figure 19:
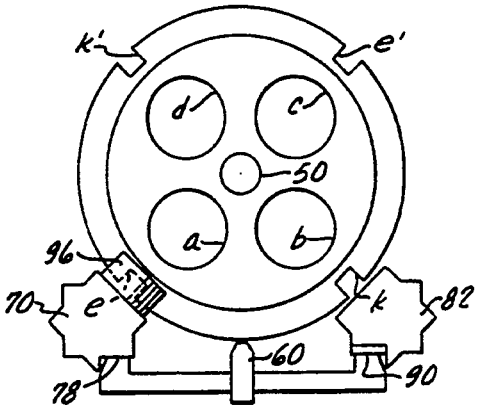
FIG. 19 is a view similar to FIG. 18 showing the revolver cylinder sear released and the revolver cylinder rotated 45° as driven by the left operating rod.

An ammunition receiver and rammer means is mounted on the gun frame 10 in the ammunition receiver region 38 and includes the following:

An elongated sprocket wheel 128 is mounted on a keyed extension 130 of the gas control rod 50 coaxially with the revolver cylinder for rotation therewith, the sprocket wheel 128 extending from proximate the rear face of the revolver cylinder rearward through the ammunition receiver region. As best illustrated in FIGS. 10 and 17, the sprocket wheel 128 has four open longitudinal flutes 132, 134, 136, 138, formed thereon corresponding in location with the four cylindrical chambers a, b, c, d, in the revolver cylinder, each open flute having a cross-sectional curvature corresponding to and registering that of the inward arcuate portion of the corresponding cylindrical chamber. The cross-sectional curvature of each flute extends for less than 180° so that each flute is open for receiving the inwardly disposed exterior portion of a cylindrically cased ammunition round, the round being longitudinally slidable in the flute with its outwardly disposed exterior portion exposed exteriorly of the flute.

An ammunition receiving port 140 is defined on the left side of the gun frame at the nine O'Clock position in registration with the sprocket wheel 128, A hinged receiver cover 142 secured in its closed position by a removable pin 144 defines the upper edge of the ammunition receiving port 140 and extends around the gun frame to its hinge pin connection 146 on the right side of the gun frame at the three O'Clock position.

The hinged receiver cover 142 extends in circularly concentric spaced overlying relationship with the sprocket wheel 128 and has a forwardly facing helical cam surface 148 formed at the interior periphery thereof and extending from the rear of the ammunition receiving port 140 to adjacent the rear face 48 of the revolver cylinder at the three O'Clock position.

The exterior side of the helical cam surface 148 is shown at 150 in FIGS. 1 and 2, The surface is slanted slightly from the radial direction respecting the axis 42. In conjunction with the sprocket wheel, the receiver cover 142 acts as an elongated ammunition receiving and ramming means whereby each fresh ammunition round successively fed through the ammunition port 140 to an empty flute on the sprocket wheel at the nine O'Clock position is carried in rotation with the sprocket wheel and revolver cylinder while having its outwardly disposed portion in rear engagement with the helical cam surface 148, thus causing the round to be progressively rammed or slid forward into the corresponding cylindrical chamber while pushing any ammunition case contained in such chamber progressively forward and out of the chamber, as the chamber is rotated from the nine O'Clock position to the three O'Clock position looking forward along the revolver cylinder axis 42. This results in a fully chambered new ammunition round in the three O'Clock position, with any former spent ammunition case being fully emerged from the revolver cylinder into the spent case receiving and ejection region 40, and with the fully chambered fresh ammunition round in the three O'Clock position being ready for movement to the six O'Clock position for registration with the gun barrel and firing upon the next 90° rotation of the revolver cylinder. A revolver cylinder cover 152 is hinged by a hinge pin 154 on the right side of the gun frame at the three O'Clock position and is held shut by a pair of latches 156 at the nine O'Clock position on the left of the gun frame. The receiver and revolver cylinder covers 142, 152 are shown in their open position in FIG. 5.

A spent case ejection port 158 is defined on the right side of the gun frame at the three O'Clock position by a housing 160 which defines a receiving chamber for spent ammunition cases as they are moved progressively forward and emerged out of the cylindrical chambers of the revolver cylinder. The housing is bolted to the gun frame in the spent ammunition case receiving and ejection region 40 thereof with the upper housing portion and the right side of the housing where the ejection port 158 is formed extending a short distance forward and in overlying relationship with the front end 20 of the gun frame proper.

The ejection chamber housing 160 has an internal rearward facing helical cam surface 162 formed around the periphery thereof in general parallel relationship with the helical cam surface 148 of the receiver cover, for engaging the front ends of the spent ammunition cases as they progressively emerge out of the revolver cylinders, the exterior side of the helical cam surface being generally indicated in FIG. 1 at 164.

As best seen in FIG. 12, an ejection sprocket wheel 166, having four 90° evenly spaced open flutes is rotatably mounted on the distal rearwardly turned end 168 of a crank arm 170, the opposite end of which is turned forwardly and rotatably mounted to the ejection chamber housing 160 and spring biased to the position shown in FIG. 12 by a tension spring assembly 171 at the front end of the housing 160. The sprocket wheel 168 is free to be displaced against spring bias into an upper area 172 of the housing 160 by rotation of the crank arm 170 about its forward connection to the housing. This occurs when a spent case S2 partially emergent in the 12 O'Clock position is moved by revolver cylinder to the three O'Clock position causing the previously emergent spent ammunition case S1 in the three O'Clock position to be ejected out the ejection port 158 while rotating the fluted sprocket wheel 156 about its axis and resulting in the partially emergent spent case S2 formerly in the 12 O'Clock position to fully emerge while moving to the three O'Clock position.

Figure 4:
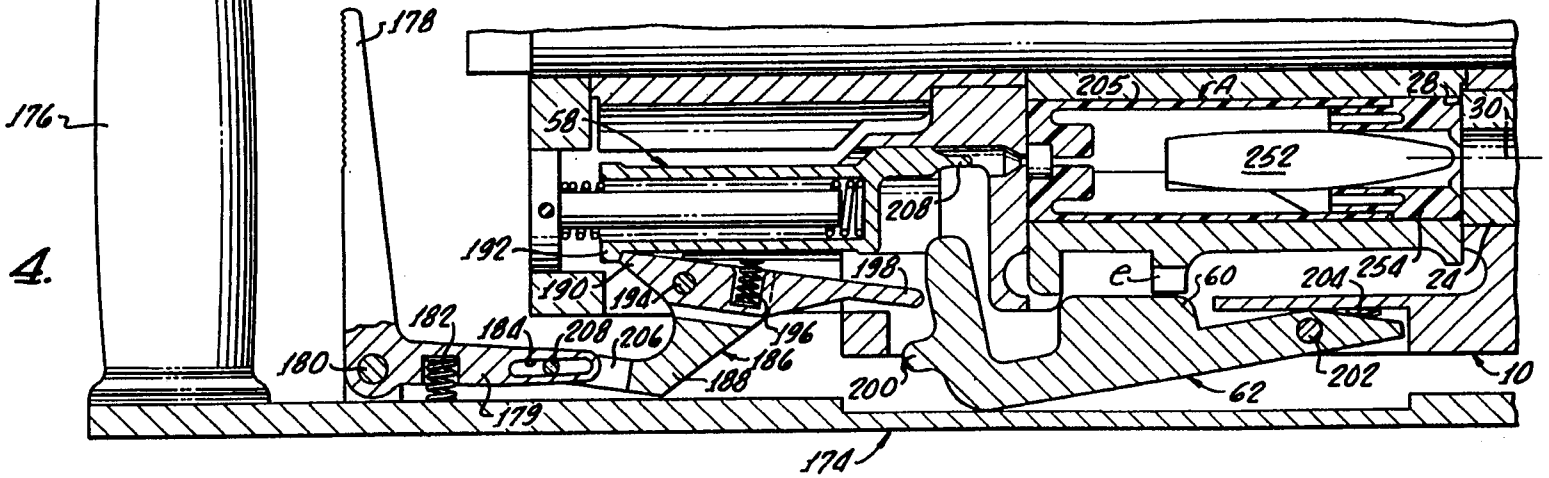
FIG. 4 is an enlargement of a rear portion of the cradled gun illustrated in FIG. 3 showing the operating mechanism in another position.

As seen in FIGS. 3 and 4, the revolver gun frame 10 is mounted in a gun cradle 174, at the rear end of which is mounted an upstanding handle 176 and a trigger 178. The trigger 178 and a forward extension 179 thereof pivots about a pin 180 against a compression spring 182. The forward extension 179 of the trigger has an elongated slot 184 formed therein and cooperates with a multiple coincident sear assembly 186 to sear a rear collar 192 of the spring loaded firing pin carrier 58 in the cocked position.

Figure 20:
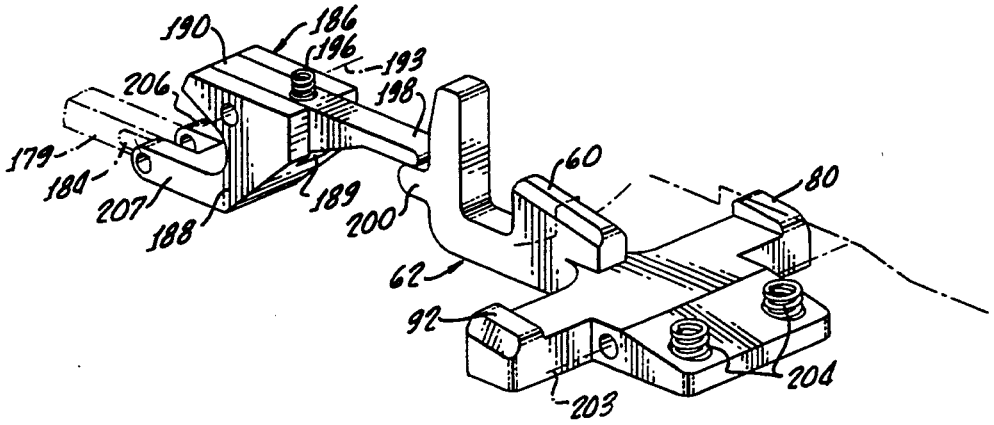
FIG. 20 is a perspective view more clearly illustrating the revolver cylinder sear and its cooperation with the firing pin sear and trigger mechanism.

As best seen in FIG. 20, the multiple coincident sear assembly 186 includes an outer member 188 having an upper central slot 189 therein, in which is disposed a coincident inner central sear 190. The outer sear member 188, as well as the inner central sear member 190, are both pivotal about a common pivot axis 193 provided through the use of a common pivot pin 194 (FIG.

4). Thus, the outer sear 188 and the inner sear 190 pivot relative to the gun frame 10 as well as relative to one another about the common pivot pin 194 on the axis 193.

The central coincident sear 190 is urged into engagement with the collar 192 of the firing pin carrier 58 by a compression spring 196. The central sear 190 has a forwardly extending arm 198 which is engagable by a rearwardly protruding tang 200 on the revolver cylinder sear 62 in order to pivot the central sear about the axis 193 against the compression spring 196 and disengage the central sear from the collar 192 of the firing pin carrier 58.

This arrangement insures that regardless of the actuation of the trigger which disengages the outer sear 188, the inner sear 190 will remain engaged under the influence of its compression spring 196 to prevent the gun from firing until the key 60 on the revolver cylinder sear 62 has engaged in one of the revolver sear keyways e, k, e', k', thus permitting the revolver cylinder sear 62 to pivot about a pivot pin 202 (FIG. 4) on an axis 203 under the influence of a pair of compression springs 204, thus permitting the forward tang 200 to disengage the central sear 190 by pushing upwardly on the forward extension arm 198 of the central sear 190. Thus, the gun cannot be fired until it is indexed to the proper position with a fresh round in the six O'Clock position coincident with the barrel axis 30.

The outer sear 188 has a pair of rearwardly extending lower legs 206, 207, between which the forward extension 179 of the trigger extends, with a pin 208 extending between the legs 206, 207 and through the elongated slot 184.

As seen in FIG. 4, a telescoped ammunition round A having a cylindrical plastic case is disposed in the six O'Clock position in registration with the barrel bore axis 30 and is ready fire. The revolver cylinder sear 62 is frozen at a moment of time in the process of beginning to pivot about pin 202 under the influence of compression springs 204 to engage its key 60 in the revolver cylinder key-way e, and to engage its rearward tang 200 with the forward extension arm 198 of the central sear 190. Moving the upper portion of the trigger 178 forward at this instant in time will not release the firing pin carrier 58 because the central sear 190 remains in engagement with the rear collar 192 under the influence of the compression spring 196. However, once the revolver cylinder sear 62 pivots upwardly, pushing the upper end of the trigger 178 forward will disengage the searing surfaces of the outer sear 188 by pivoting the outer sear about the pin 194 against the influence of the compression spring 182 resulting in the release of the spring loaded firing pin carrier 58 and forward movement of the firing pin 208 carried thereby to fire the ammunition round A, this being the condition of the gun mechanism depicted in FIG. 3, frozen at the instant of impact just prior to detonation of the round.

As seen in FIG. 3, the barrel 24 is locked to the gun frame by conventional bayonet lugs (not shown), inserted into conventional receiving slots 209 and rotated to locking position. A spring loaded key 210 engages a corresponding slot 211 in the barrel to fix the rotary position of the barrel relative to the gun frame when the barrel is inserted and rotated to the locked position.

Referring now to FIG. 8, each drive cylinder, typified by the left drive cylinder L, extends forward through an arm 120 of the yoke 68 and is locked thereto by a pair of threaded nuts 212, 213, which engage the threaded end of the drive cylinder protruding forward from the yoke arm 120. The threaded nuts 212, 213 are exteriorly engaged by a spring detent cover cap 214.

A principal structural tube 216 of the drive cylinder itself is externally threaded as indicated at 218 at its rear end where it screws into an accommodating threaded recess at the front end 20 of the gun frame 10. The intermediate portion of the principal tube 216 has a conventional ring spring buffer 220 formed thereon, so that when the gun is fired and the gun mechanism and barrel recoil relative to the gun frame, a series of ring springs 222 are compressed by virtue of a rear threaded cap member 224 of the ring spring housing 225 being longitudinally locked to the gun cradle 174 by a pivotal abutment 226. By the same token, the ring springs are compressed in the opposite or forward direction to buffer the counter recoil relative to the gun frame when the operating rod 70 moves forward and returns to its rest position, and forward movement of the cap member 224 is opposed by a fixed forward abutment 227.

Figure 21:
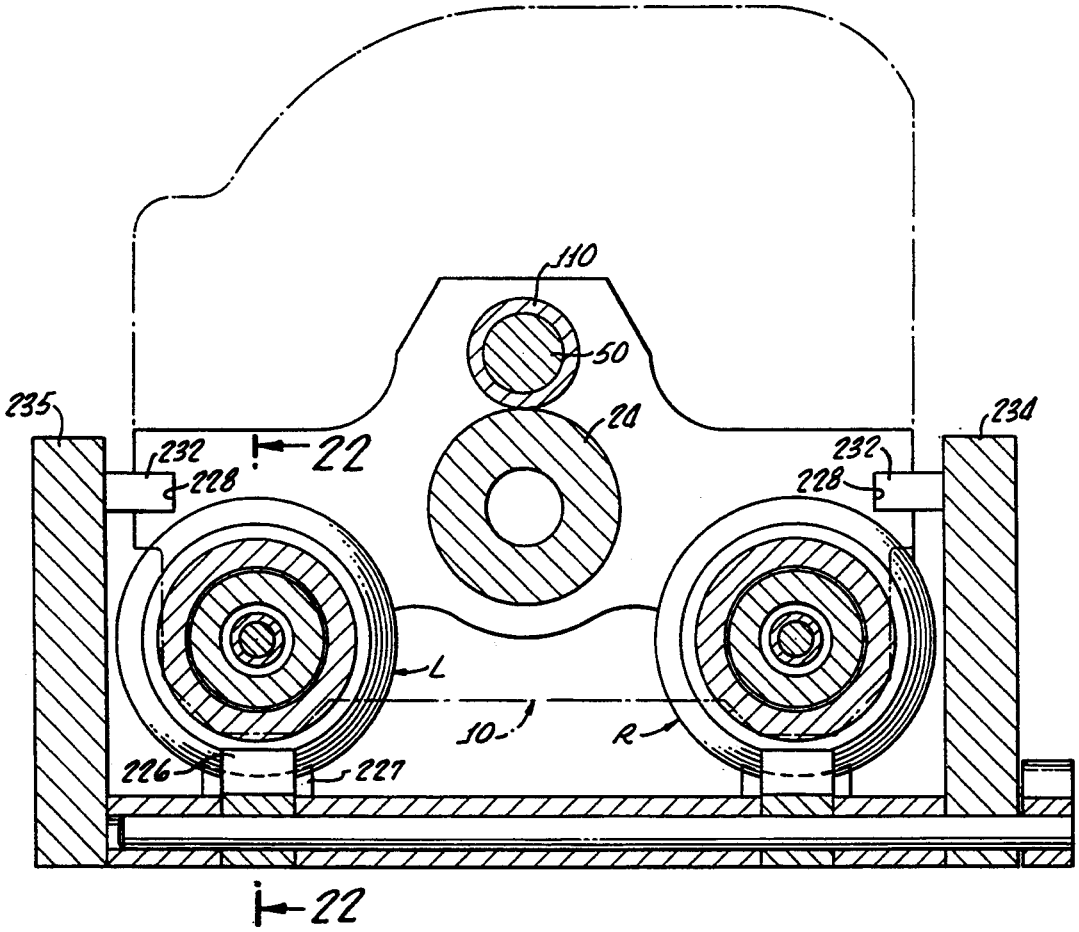
FIG. 21 is a cross-section, partly in phantom line, taken along line 21—21 of FIG. 3 and illustrating the engagement of the gun with the gun cradle; and, FIG. 22 is a view, partially in cross-section taken along line 22—22 of FIG. 21.
Figure 22:
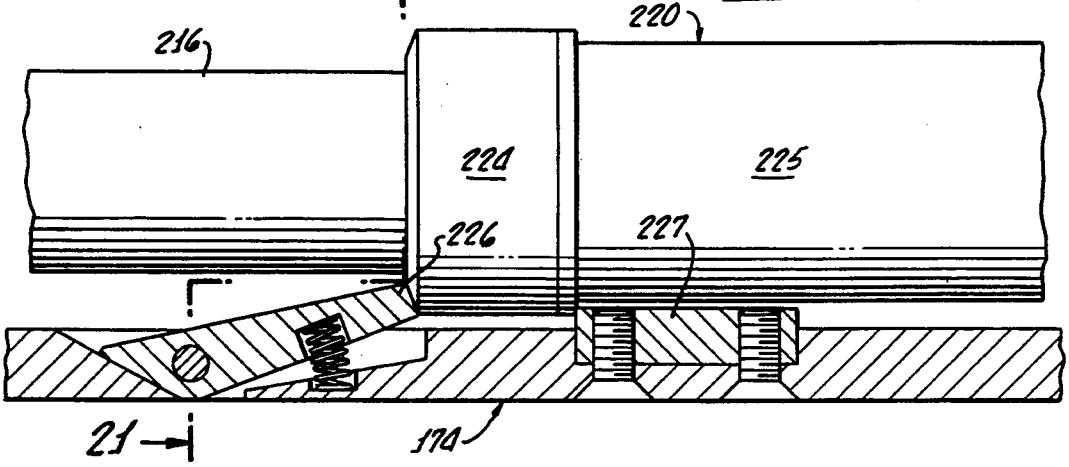

The mounting of the gun to the gun cradle is also illustrated in FIGS. 21 and 22. A pair of mounting slots 228 respectively disposed on opposite sides of the gun frame and a corresponding pair of aligned mounting slots 230 respectively disposed at opposite sides of the yoke 68 receive in sliding engagement a a pair of inwardly extending keys 232 respectively disposed on opposite side walls 234, 235 of the cradle 174. The gun is slid forward depressing the pivotal abutment 226 until it reaches the position shown in FIG. 22 whereupon the pivotal abutment 226 under influence of its compression spring 236 snaps upwardly to lock against the end cap 224 of the ring spring housing 225.

Referring now to FIGS. 6 and 11 thru 14, the reset cam roller 56 is mounted on a spring loaded carrier 237 which engages the rear collar 192 on the spring loaded firing pin carrier 58 to periodically cock or reset the same into engagement with the composite sear 186 each time the gun is fired and the revolver cylinder rotates.

As seen in FIGS. 14 thru 16, the firing pin 208 is aligned with the barrel axis at the six O'Clock position. The reset cam roller 56 is centered 45° in advance thereof at the 4:30 o'clock position, such that the reset cam roller 56 is in a trough, and its carrier 237 is forward when a revolver chamber carrying a fresh ammunition round arrives at the six O'Clock position and is ready to be fired.

In FIG. 14, the reset cam roller 56 is at the juncture of the rear cam race r and the bridging protrusion p, and consistent with FIG. 3, the firing pin carrier has been released to its forward position, and the instant of time depicted is where the firing pin has impacted the ammunition round, but just prior to detonation of the round, so that both operating rods 70, 82 are in their forward or rest positions with their respective cam driver/followers 74, 86 being disposed forward of and out of engagement with the revolver cylinder.

As seen in FIG. 10, a feeder 240 mounted over the ammunition receiving port 140 on the left side of the gun frame and secured by the removable pin 144 urges a series of fresh cylindrically cased telescope ammunition rounds into the ammunition receiving port for stripping by an empty flute of the sprocket wheel 128 in the nine O'Clock position.

FIG. 14 depicts the condition of the gun as illustrated in FIG. 3. The cam driver/follower 86 associated with the right operating rod 82 has emerged from the open exit end X' of the U-shaped open cam channel 54, and the right operating rod 82 has moved to its rest position where its cam recess 90 accommodates upward movement of the right arm cam 92 of the: revolver sear, the key-way e has come into registration with the key 60 of the revolver sear r, such that the r sear has pivoted upwardly to disengage the central firing pin sear 190 from the firing pin carrier 58, allowing the firing pin carrier to come forward. FIG. 14 depicts the instant of impact of the firing pin with the ammunition round A just prior to detonation, such that there is no barrel gas pressure at the instant depicted in FIG. 14. Nevertheless, by inspection of the position of the rotary valve 112 as determined by the rotary position of the revolver cylinder and the gas control rod 50, one can see that if there was gas pressure in the barrel it would flow through the orifice 124 to the gas chamber 114 of the left drive cylinder L.

FIG. 15 depicts the condition shortly following the detonation of the round shown in the six O'Clock position in FIG. 14. The gas piston 72 of the left operating rod 70 has moved the operating rod rearwardly causing its cam recess ramp 78 to engage the left arm cam 80 of the revolver sear, pivoting the revolver sear downwardly to disengage the key 60 from the revolver key-way e, and causing the associated cam driver/follower 74 to enter the aligned open entrance end E of the U-shaped open cam channel 52 and to drive the revolver cylinder through 45° of rotation at which instant the energy thus imparted by the operating rod is reflected as rotational kinetic energy of the revolver cylinder and potential energy stored in the compressed operating rod spring 94, with the cam driver/follower 74 inits rearmost position. Also, the reset cam roller 56 has ridden to the apex of the rear surface of the rear race r thus causing its carrier 237 to cock the spring loaded firing pin carrier 58 in readiness for the next shot. The overall gun has recoiled a short distance in its cradle by way of compression of the ring spring buffers formed on the left and right drive cylinders. The operating rod 70 cannot turn about its axis 66 because its splined region 76 is in sliding engagement with a corresponding splined cross-sectional configuration of a passage in the gun frame.

In FIG. 16, the kinetic energy of the revolver cylinder and the potential energy stored in the operating rod compression spring have driven the cam driver/follower 74 out of the exit end X of the U-shaped open cam channel 52. However, the operating rod 70 has not quite returned to its rest position such that the left arm cam 80 of the revolver sear 62 is holding the revolver sear pivoted downwardly and the central firing pin sear 190 under the influence of its compression spring is engaged with the rear collar 192 of the firing pin carrier 58. Although the revolver cylinder has moved a full 90° from its position in FIG. 14, it cannot fire again until it is indexed and locked by the revolver sear key 60 engaging in the revolver key-way k.

As represented in FIG. 14, a fresh round A ready to fire is contained in chamber "a" in the six O'Clock position. The next round to be fired B is just fully chambered by the fixed cam surface 148 in the chamber b in the three O'Clock position, and the spent ammunition case S1 is fully emergent from the revolver cylinder at the three O'Clock position. The third round to be fired C is half way chambered in the chamber c in the twelve O'Clock position and the spent ammunition case S2 previously chambered therein is half emergent at the twelve O'Clock position, it being noted that the longitudinal distance between the forwardly facing ramming cam 148 and the rearwardly facing spent case receiving cam 162 is two round lengths. The fourth ammunition round to be fired D has just entered an open flute at the nine O'Clock position on the sprocket wheel 128 and is ready for engagement with the forward facing ramming cam 148 so as be progressively rammed into revolver chamber d while pushing the empty case S3 contained therein progressively out of the chamber d against the guidance of rearward facing ejection cam 162.

Referring to FIG. 4, a typical cylindrically cased telescoped ammunition round a includes a right cylindrical plastic case 250, a projectile 252 and a front end cap 254. Upon detonation of the round A, the plastic case 250 stretches and the front end cap 254 momentarily seals against the rear face 28 of the barrel 24. The hot propellant gasses never directly touch the revolver chamber "a", but directly enter the barrel bore following the projectile, and there is no need for special mechanical seals to bridge the gap between the front face of the revolver cylinder in the rear face of the barrel.

I claim:

1. A self-powered automatic revolver gun for firing cylindrically cased telescoped ammunition rounds at a high rate of fire, said gun comprising:

(a) a gun frame having top, bottom, and opposite lateral sides and having forward and rear ends:

(b) a revolver cylinder, having an even plurality of at least four cylindrical ammunition chambers;

(c) a gun barrel mounted to and extending forward from said gun frame, said gun barrel having forward and rear ends, a longitudinal axis, and a bore centered on and extending along said longitudinal axis of the gun barrel;

(d) said gun frame having a breech region disposed rearwardly of and adjacent the rear end of the gun barrel for mounting the revolver cylinder, an ammunition receiver region disposed rearwardly of and adjacent the breech region, and a spent ammunition case receiving and ejection region disposed forward of and adjacent the breech region;

(e) the revolver cylinder having a central longitudinal axis, a substantially cylindrical exterior surface disposed coaxially therewith, arid rear and forward end faces, with said plurality of cylindrical chambers extending longitudinally through the revolver cylinder and its end faces on axes parallel to, and disposed at uniformly spaced loci arranged in a circular array centered on said central longitudinal axis of the revolver cylinder with said loci being evenly spaced a predetermined angular distance apart to together encompass 360°;

(f) means rotatably mounting the revolver cylinder in the breech region of the gun frame for rotation about its central longitudinal axis, with the front end face of the revolver cylinder disposed adjacent the rear end of the gun barrel and with the central longitudinal axis of the revolver cylinder disposed parallel to but offset from the gun barrel axis by the radius of said circular array of revolver chamber loci, whereby rotation of the revolver cylinder brings said axes of the cylindrical chambers of the revolver cylinder successively into coaxial registration with the axis of the gun barrel;

(g) means for triggering the gun to fire;

(h) firing means responsive to the triggering means for firing an ammunition round contained in the chamber of the revolver cylinder in coaxial registration with the gun barrel;

(i) at least two substantially U-shaped open cam channels similarly formed on the exterior cylindrical surface of the revolver cylinder respectively at successive circumferentially spaced apart locations, with the bend of each U-shaped cam channel disposed proximate the rear end face of the revolver cylinder, and with the respective legs of each U-shaped cam channel extending forwardly on said exterior cylindrical surface and through the periphery of the front end face of the revolver cylinder for providing respectively open entrance and exit ends for each U-shaped cam channel at the periphery of the forward end face of the revolver cylinder;

(j) the open entrance and exit ends for each U-shaped cam channel being circumferentially spaced apart at the forward end face of the revolver cylinder by the same predetermined angular distance by which the axes of the revolver cylinder chambers are spaced, with the exit end of each U-shaped cam channel being spaced apart from the entrance end to the circumferentially successive U-shaped cam channel by the same predetermined angular distance, and with the sum of the angular distances as thus stated between said entrance and exit ends for each U-shaped cam channel and between successive U-shaped cam channels adding to 360°;

(k) gun drive means mounted to said gun frame and extending forwardly therefrom alongside the gun barrel and responsive to the firing of successive ammunition rounds for successively driving said revolver cylinder through said predetermined angular distance in the same rotary direction, upon firing of each successive ammunition round, said gun drive means including:

(i) first and second elongated drive cylinders mounted to said gun frame and extending forwardly therefrom alongside said barrel on separate axes, said separate axes being disposed parallel to the barrel axis outboard of the exterior cylindrical surface of the revolver cylinder, and said separate axes being circumferentially spaced apart respecting the revolver cylinder by said predetermined angular distance;

(ii) first and second elongated operating rods respectively mounted in the first and second drive cylinders, and restricted to linear, non-rotary reciprical rearward and forward movement therein between a rear position and a forward or rest position;

(iii) each operating rod having a gas piston formed proximate the forward end thereof and having a cam driver/follower mounted thereon proximate the rearward end thereof, said cam driver/-follower being exposed exteriorly of the drive cylinder and extending inwardly from the operating rod toward the circumference of the revolver cylinder in alignment, with the exterior cylindrical surface thereof for successively entering aligned entrance ends of said U-shaped cam channels and exiting the exit ends tbereof as the revolver cylinder rotates and the operating rod reciprocates;

(iv) means spring loading the operating rods toward their forward rest positions;

(v) each cam driver/follower being disposed a spaced distance forward of the front end face of the revolver cylinder when the associated operating rod is in its forward or rest position: and, (vi) gas channeling and diverting means coupled between the barrel and forward end portions of the first and second drive cylinders, and responsive to the firing of successive ammunition rounds and to the rotary position of the revolver cylinder for tapping gas from the barrel bore and alternately directing successive gas to the first and to the second drive cylinders to alternately drive the first and second operating rods rearwardly so as to drive the associated cam driver/-follower into an aligned entrance end of an aligned U-shaped cam channel, and in turn rotate the revolver cylinder through said predetermined angular distance as the cam driver/follower traverses the aligned U-shaped cam channel and emerges from the exit end thereof;

(l) indexing means, responsive to the position of the operating rods and the revolver cylinder, for unlocking and locking the revolver cylinder from rotation between firing of successive ammunition rounds.

(m) ammunition receiver and rancher means mounted on the gun frame in the ammunition receiver region thereof and responsive to rotation of the revolver cylinder for receiving fresh cylindrically cased ammunition rounds and progressively ramming a fresh cylindrically cased ammunition round into each revolver chamber following firing of the round contained therein while progressively pushing forward and out of the same revolver chamber the spent cylindrical case of the fired round; and, (n) spent case receiving and ejection means mounted on the gun frame in the spent ammunition case receiving and ejection region thereof and responsive to rotation of the revolver cylinder for receiving spent ammunition cases as they progressively emerge from the successive revolver chambers and for ejecting fully emerged cases from the gun.

2. The apparatus of claim 1, wherein:

(a) said revolver cylinder has four cylindrical ammunition chambers extending therethrough;

(b) said predetermined angular distance is 90°; and, (c) said U-shaped open cam channels consist of a first and a second U-shaped open cam channel.

3. The apparatus of claim 2, wherein:

(a) the means rotatably mounting the revolver cylinder in the breech region of the gun frame includes an elongated gas control rod journaled in the gun frame, said control rod being disposed coaxially with the revolver cylinder, being connected thereto for rotation therewith, and extending forward therefrom; and, (b) the gas channeling and diverting means responsive to the rotary position of the revolver cylinder includes a gas valve coupled to a forward end portion of said control rod and responsive to rotation of the rod about said axis.

4. The apparatus of claim 2, wherein the ammunition receiver and rammer means comprises:

(a) an elongated sprocket wheel disposed proximate the rear face of the revolver cylinder and extending coaxially therewith rearward through the ammunition receiver region;

(b) means mounting the sprocket wheel coaxially with the revolver cylinder for rotation therewith;

(c) said sprocket wheel having four open longitudinal flutes formed therein corresponding in location with the cylindrical chambers in the revolver cylinder, each open flute having a cross-sectional curvature corresponding to and registering with that of an inward portion of a corresponding cylindrical chamber, which cross-sectional curvature extends for less than 180° so that each flute is open for receiving and engaging an inwardly disposed exterior portion of a cylindrically cased ammunition round;

(d) means defining an ammunition receiving port on one side of the gun frame in registration with said sprocket wheel; and, (e) an elongated ammunition guide and ramming means mounted to said gun frame in the ammunition receiver region and overlying said sprocket wheel in circularly concentric spaced relationship therewith and extending for approximately 180° around the sprocket wheel from said receiving port; with (f) said ammunition guide and ramming means having a forwardly facing helical cam surface formed at the interior periphery thereof and extending from the rear of the ammunition receiving port to adjacent the rear face of the revolver cylinder, whereby each fresh ammunition round successively fed through the ammunition receiving port to an empty flute on the sprocket wheel, as the sprocket wheel rotates with the revolver cylinder, is carried in rotation with the revolver cylinder while being rammed forwardly by rear engagement with said helical cam surface into the corresponding cylindrical chamber and pushing any spent ammunition case contained therein progressively forward out of the cylindrical chamber into the spent case receiving and ejection means.

5. The apparatus of claim 4, wherein the spent case receiving and ejection means comprises:

(a) means defining a spent case ejection port disposed on the opposite side of the gun frame from said ammunition receiving port at approximately 180° about the revolver cylinder axis therefrom;

(b) means defining a receiving chamber for spent ammunition cases as they are moved progressively forward and emerged out of the cylindrical chambers of the revolver cylinder; and, (c) means mounted in said chamber for successively ejecting fully emergent spent ammunition cases from the receiving chamber out the spent case ejection port.

6. The apparatus of claim 5, wherein the receiving chamber for spent ammunition cases includes an internal rearward facing helical cam surface for engaging the front ends of the spent ammunition cases as they progressively emerge out of the revolver cylinder chambers.

* * * * *